US005916034A

United States Patent [19]

Lancia

[11] Patent Number: 5,916,034

[45] Date of Patent: Jun. 29, 1999

[54] MINIATURE GOLF HOLE SYSTEM

[76] Inventor: Steven A. Lancia, 20 Moshassuck Rd., Lincoln, R.I. 02865

[21] Appl. No.: 08/861,890

[22] Filed: May 22, 1997

[51] Int. Cl.[6] ..... A63B 69/36

[52] U.S. Cl. ..... 473/157; 473/171

[58] Field of Search ..... 473/157, 159, 473/162, 171

[56] References Cited

U.S. PATENT DOCUMENTS

| | | | |
|---|---|---|---|
| 1,967,904 | 7/1934 | Roberts . | |
| 2,176,622 | 10/1939 | Davis | 473/159 |
| 2,515,847 | 7/1950 | Winkler | 473/171 |
| 3,418,897 | 12/1968 | Humalainen . | |
| 3,446,122 | 5/1969 | Raichle et al. . | |
| 3,995,079 | 11/1976 | Haas, Jr. . | |
| 4,875,682 | 10/1989 | Paolillo . | |
| 4,966,370 | 10/1990 | Morris | 473/159 |
| 4,988,106 | 1/1991 | Coonrod . | |
| 5,026,580 | 6/1991 | Hammon . | |
| 5,366,224 | 11/1994 | Stanwyck et al. | 473/162 |
| 5,419,561 | 5/1995 | Weber . | |
| 5,655,971 | 8/1997 | Wayne | 473/171 |

*Primary Examiner*—Mark S. Graham
*Attorney, Agent, or Firm*—Salter & Michaelson

[57] ABSTRACT

A miniature golf hole system includes an expanded polystyrene foam base having a porous rubberized material applied to an upper exposed side of the expanded polystyrene base, and a porous outdoor carpeting applied to the exposed surface of the rubber material. The system is designed for improving drainage of water from the carpeting. The system further includes a plurality of drainage channels selectively cut in the expanded polystyrene base for emptying any accumulated water out a bottom of the miniature golf hole system. A second embodiment is also disclosed wherein a polyurethane coating is substituted for the rubberized material.

10 Claims, 3 Drawing Sheets

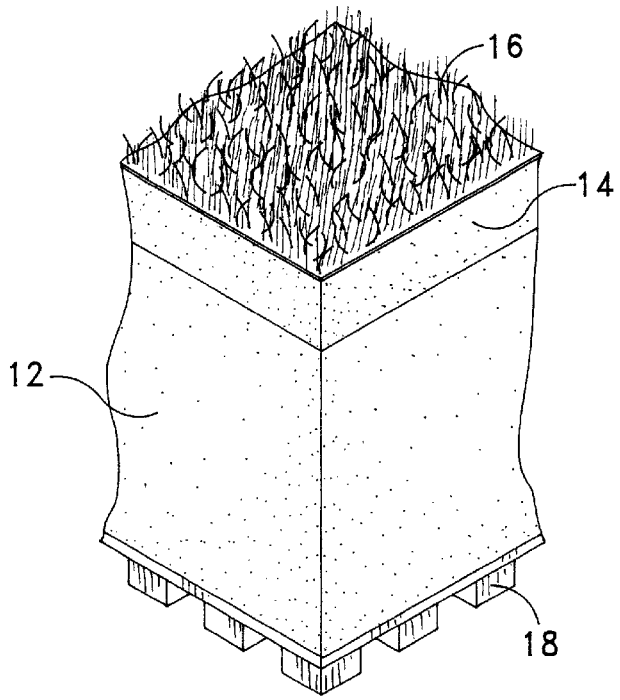
FIG. 3
FIG. 4
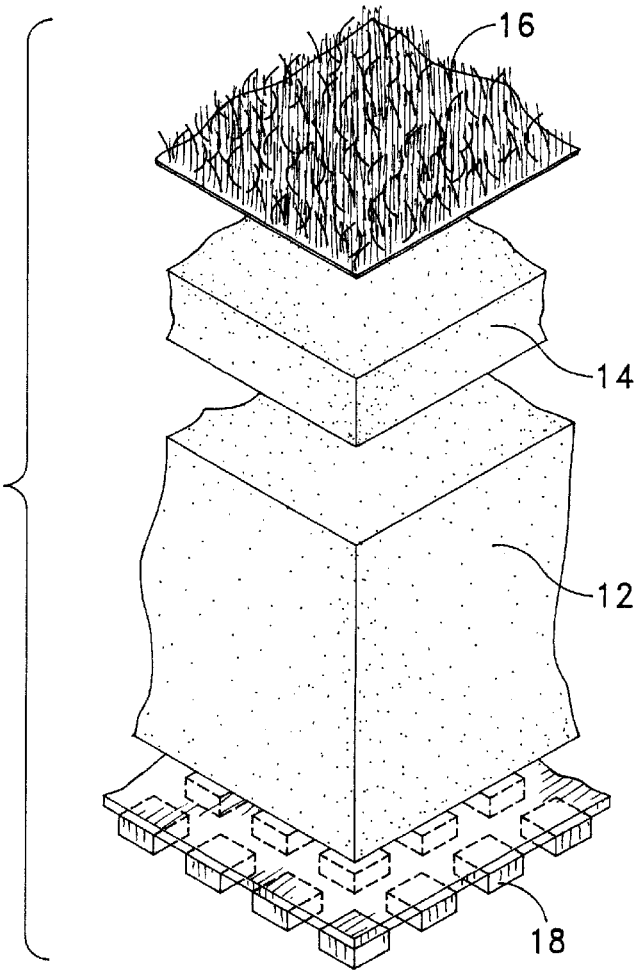

MINIATURE GOLF HOLE SYSTEM

BACKGROUND AND SUMMARY OF THE INVENTION

This invention relates generally to miniature golf hole courses, and more particularly to a superiorly constructed, multiple layer miniature golf hole system having improved drainage characteristics which provide for a longer lasting, aesthetically pleasing, and more accurate miniature golf and practice putting green surface.

Miniature golf is a game which is well known and enjoyed by children and adults alike. U.S. Pat. No. 3,446,122 issued to L. Raichle et al. and U.S. Pat. No. 1,967,904 issued to Roberts both disclose multi-layered constructions which are pertinent to the instant invention. Raichle et al. discloses a multi-layer construction particularly suitable for tennis courts, whereas Roberts shows a rubber surface material. However, neither of these references disclose a miniature golf hole construction system, such as the one contemplated by the instant invention.

Traditionally, miniature golf hole courses have been constructed from a cement foundation base having outdoor carpeting attached to the top surface of the cement. There are a number of disadvantages associated with these traditionally constructed miniature golf hole courses. First of all, considering that miniature golf is traditionally an outdoor game, flooding of the course holes is commonplace during and after inclement weather. More specifically, rain causes the course to become unplayable not only during the inclement weather, but also for a time period following such inclement weather due to the poor drainage and slow drying characteristics associated with these conventionally constructed miniature golf hole courses. Secondly, such foul weather eventually causes the outdoor carpeting to become delaminated from the cement foundation, resulting in ripples and untrue play on the putting green surface. Also, there is cracking of the cement foundation due to freeze and thaw conditions, frost heaves, etc. Specifically, the porous nature of the concrete absorbs water later resulting in cracks and time-consuming and expensive maintenance of the golf hole system.

The multiple layer construction for the miniature golf hole system of the instant invention has improved drainage characteristics due to the relatively soft and porous nature associated with each layer of the system. The instant miniature golf hole system is constructed to allow water to pass through each layer and subsequently out the bottom or sides of the system, thus preventing puddles or water pockets from forming on the top surface of the outdoor carpeting which are prevalent with traditionally constructed miniature golf hole courses. Further, additional detail structure may be more easily incorporated within the green surface, i.e., sand traps, for a more aesthetically pleasing and challenging miniature golf hole course.

The instant invention is directed to a modular miniature golf hole system having a multiple layer construction for improved drainage characteristics. The system includes an expanded polystyrene foam base, of any density, having a porous rubberized material applied to the upper exposed side of the expanded polystyrene base. The system further includes indoor or outdoor carpeting applied to the exposed free surface of the rubber material providing a neat and clean finished golf green putting surface. The expanded polystyrene foam base has a plurality of drainage channels selectively cut therein for allowing rain water that passes through the porous outdoor carpeting and rubber material and migrates towards the drainage channels to be subsequently diverted out the bottom or sides of the golf hole system.

In a second embodiment, an instaset, a term used in the industry for quick setting, hard-coat urethane is applied to the exposed surface of the expanded polystyrene foam base instead of the rubberized material which is more suitable for use with indoor holes. A plurality of selectively located PVC drainage pipes or channels are cut in the expanded polystyrene base for allowing any water which migrates to these selected locations to pass through the drainage pipes and out the bottom of the golf hole system. An optional waffling system may be further attached beneath the expanded polystyrene foam base, in either embodiment, for better drainage in connection with golf systems located in poor drainage areas.

Accordingly, among the objects of the instant invention are: the provision of a miniature golf hole system having a multiple layer construction for improved drainage characteristics; the provision of a miniature golf hole system that is modular in construction, lightweight, and easy to handle which allows for easier customer installation; the provision of a miniature golf hole system that is weather resistant and will not deteriorate over time for a longer lasting and more accurate golf green surface; and the provision of a miniature golf hole system that captures the attention of the golf player and is aesthetically pleasing in appearance.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is an enlarged perspective view of a portion of the miniature golf hole system illustrating its multiple layer construction;

FIG. 4 is an exploded perspective view showing each layer of the miniature golf hole system of the instant invention;

Corresponding reference numbers designate corresponding parts throughout the drawings.

DESCRIPTION OF THE PREFERRED EMBODIMENTS

Figure 1:
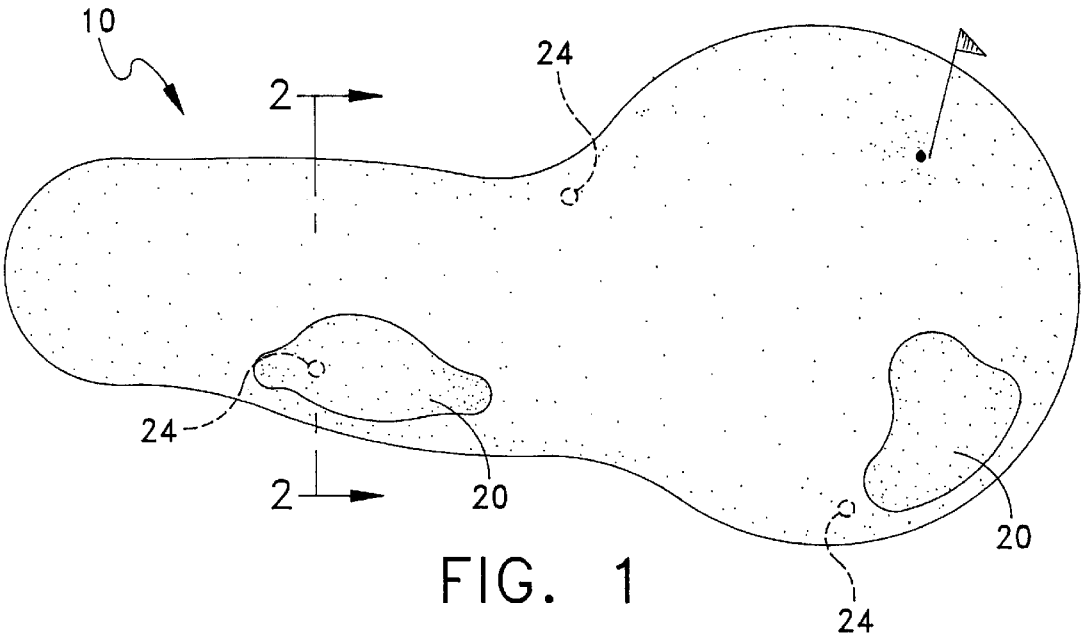
FIG. 1 is a top plan view of a golf hole of a miniature golf hole system of the instant invention.

Referring now to the drawings, and more particularly to FIG. 1, a top plan view of a miniature golf hole system of the instant invention is shown and generally indicated at 10. The golf hole system 10 is especially effective in substantially preventing the buildup of water on the golf hole system. Since most such systems are used outdoors and are subject to the elements, it is important that the system be capable of draining water. For most conventional golf hole systems prior to the present invention, failure to prevent buildup of water can cause delamination of the system's components. The present invention is constructed to eliminate such buildup of water.

As most clearly shown in FIGS. 3 and 4, the golf hole system 10 has a multiple layer construction comprising an expanded polystyrene (EPS) base 12, a rubberized porous athletic surfacing 14 disposed over the EPS base 12, and a sheet of outdoor carpeting 16 applied over the surface 14. A waffling system 18 may be further attached underneath the EPS 12 base, but this is an optional component of the system 10 which will be described in further detail as the description of the invention proceeds.

It should be understood that the design and shape of the golf hole of the system 10 depicted in FIG. 1 will not always be the same, and that each individual golf hole of the miniature golf hole system will have a different layout that may be customized to include any number of desirable shapes or characteristics. As illustrated in FIG. 1, selectively designed and located undulations and sand traps 20 may be sculptured into the putting green surface to provide a more challenging putting hole which will capture and maintain the attention of the miniature golf player. An important benefit of the instant invention is the improved drainage characteristics associated with the multiple layer construction of the miniature golf hole system 10.

There are a plurality of drainage channels 24 strategically located at each of the noticeably low areas and large flat areas of the components of the golf hole system 10 for allowing surface water captured in these areas to drain, and preventing the accumulation of undesirable rainwater and associated flooding of the golf hole system 10. As shown in FIG. 2, the drainage channels 24 are cut in the expanded polystyrene (EPS) base 12 with a router or hot wire at selected locations where accumulated water will migrate through the carpet 16 and the rubberized surface 14 so that any water that is captured in these selected low flat areas will be emptied into the drainage channels 24 and subsequently diverted out the bottom or sides of the golf hole system 10. The diameter of each channel 24 formed in the EPS foam base 12 will vary depending on the amount of wetness to be experienced by the system 10, i.e., the higher the rain fall, the larger the channel.

The golf hole system 10 is modular in construction making it lightweight and easy to handle, and allowing for easier customer installation, without any further assistance from the factory. Each element of the instant invention is widely used for a variety of different applications and thus are well known in the art. However, the combination and order of layering in the miniature golf hole system 10 of the instant invention is believed to represent a significant improvement in the art which has substantial commercial merit.

Figure 5:
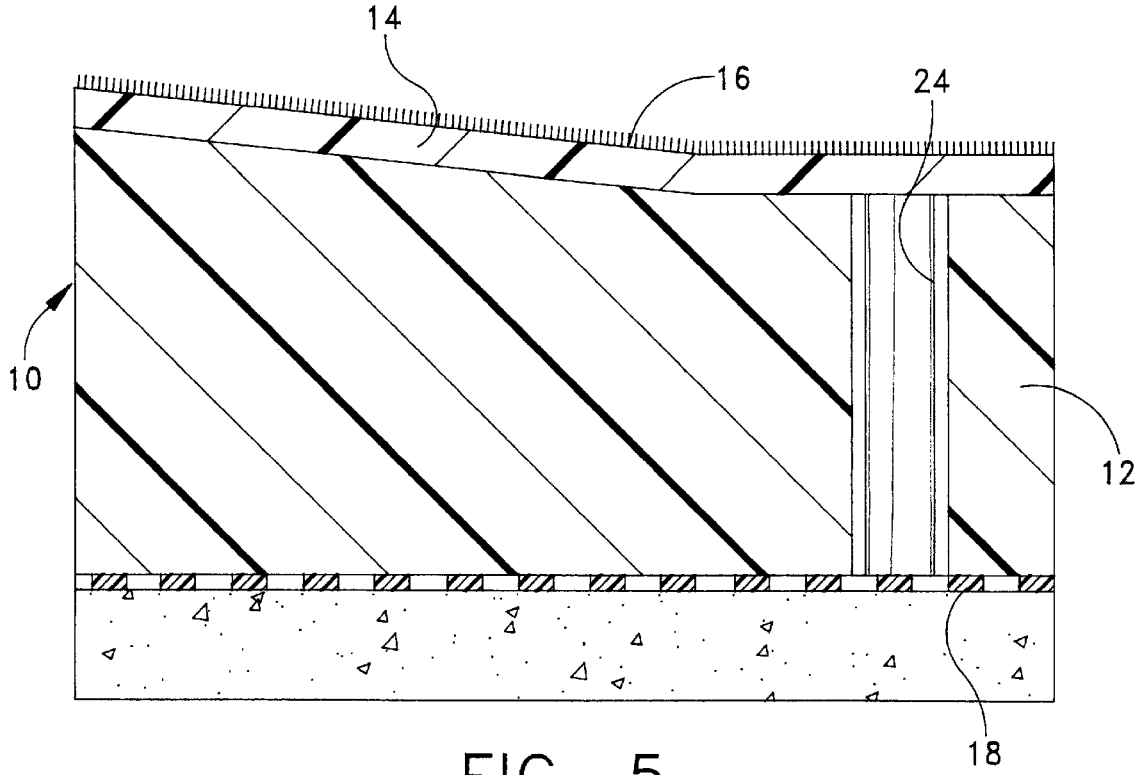
FIG. 5 is an enlargement of the cross-sectional view shown in FIG. 2.

The order of arrangement of the layers of the miniature golf hole system 10 is best illustrated in FIGS. 3–5. First, the EPS foam base 12 is prefabricated to customer specifications and has a density ranging from 0.5 to 4.0 lb./cu. ft. The thickness of each hole varies based on the particular design. Next, the athletic rubberized material 14 is then applied to the upper exposed side of the EPS base 12. The rubber material is constructed of man-made pigmented rubber granules and a polyurethane resin. The rubber material is troweled to the exposed side of the EPS foam base so it offers a monolithic seamless surface. The material 14 is troweled by skilled technicians to a desired thickness ranging from ½ to 2 inches. Last, the outdoor carpeting 16, which is fabricated from porous woven material having cut resin strands that mimic grass, as is known in the art, is applied over the athletic rubberized material 14 and attached thereto with a standard carpet adhesive. The attachment between the outdoor carpeting 16 and the athletic rubberized material 14 is very secure and unlikely to delaminate due to the bonding nature associated with the carpeting adhesive and the porous rubber material. Specifically, the carpet adhesive fills channels, which are a characteristic property of the rubber material, and becomes locked therein for permanently attaching the carpeting to the athletic rubberized surface.

Figure 2A:
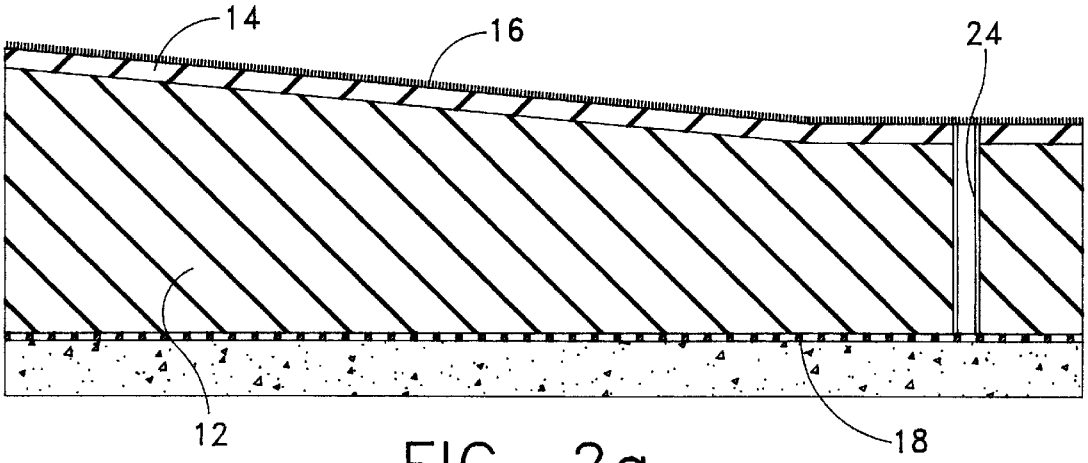
FIGS. 2*a* and 2*b* are cross-sectional views of the golf hole taken along line 2—2 of FIG. 1.
Figure 2B:
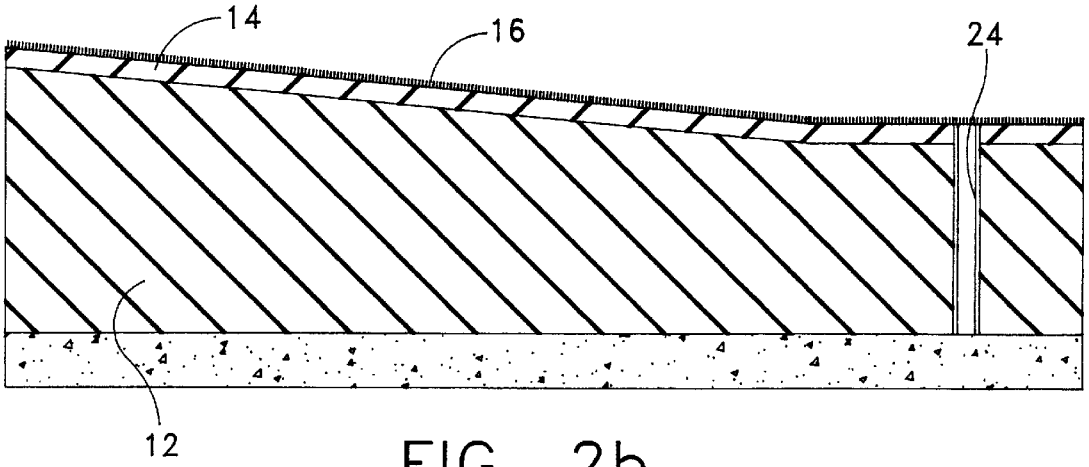

As shown in FIG. 2*a,* a waffling system 18 may be further attached by suitable means beneath the EPS foam base 12 for better draining in connection with areas that do not drain well or are subject to drainage on pitch, i.e., a ship or a buoyant dock where the water is unable to drain through the area substrate underneath the golf hole system, such as dirt, sand and ground associated with systems installed on land. The waffling system 18 allows the water to drain through, in the direction of the pitch in the undersurface substrate, hence keeping an even flow of water to a proper drainage area. Preferably, the waffling system 18 is fabricated from EPS foam or molded plastic material that is cut into a plurality of squares and subsequently attached to the bottom surface of the EPS base. FIG. 2*b* depicts the golf hole system 10 without the waffling system 18. It being understood that the waffling system is an optional component of the instant invention 10.

The miniature golf hole system 10 further includes a number of differently designed edge systems (not shown) which function to keep the golf ball in play as well as provide an aesthetically pleasing appearance. The edge systems may range from brick, rock, or any other material that provides a desirable looking finish to the miniature golf hole course.

Figure 6:
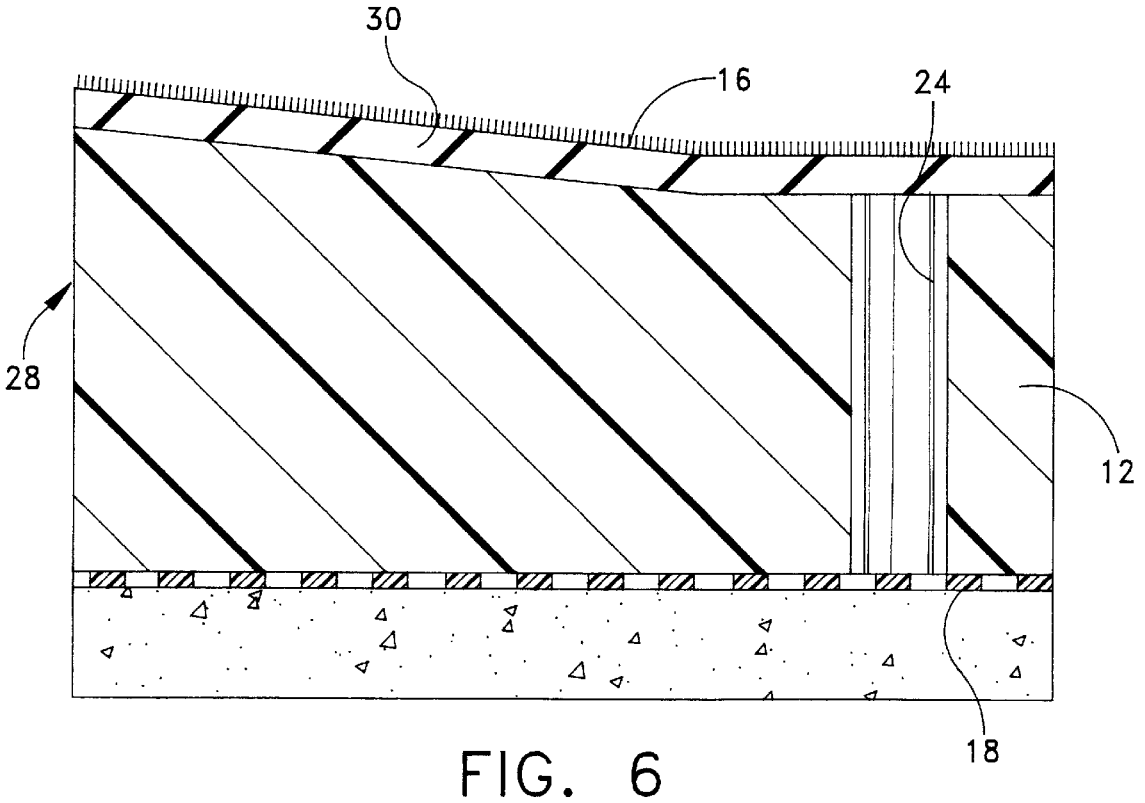
FIG. 6 is an enlarged cross-sectional view similar to FIG. 2 depicting a second embodiment of the miniature golf hole system of the instant invention.

Referring now to FIG. 6, a second embodiment of the miniature golf hole system 10 is illustrated and generally indicated at 28. This embodiment discloses a hard-coat urethane 30 as opposed to the porous rubberized material 14 located between the EPS base 12 and the outdoor carpeting 16. The hard-coat urethane 30 is applied to the upper exposed side of the EPS foam base 12 with high-pressure spray equipment. The urethane coat 30 instantly cures to provide a durable and sturdy surface that is capable of withstanding heavy walking traffic. There are a variety of different urethane-based materials available in specific hardness, softness and different mechanical strengths, and all provide sufficient applications for this embodiment of the invention. As in the first embodiment, the outdoor carpeting 16 is then applied over the urethane coating 30 with a suitable adhesive for providing a finished golf green putting surface. A plurality of PVC drainage pipes or drainage channels are cut in the expanded polystyrene base at selectively located poor drainage areas for allowing water which migrates there to be emptied out the bottom of the golf hole system 10.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. An artificial golf putting surface construction comprising:

an expanded polystyrene foam base layer having a downwardly facing surface which is received on a supporting surface, and an upwardly facing surface having a predetermined surface contour;

a soft, porous intermediate layer applied to said upwardly facing surface of said base layer, said intermediate layer having a generally uniform thickness which conforms to the predetermined surface contour of said base layer;

a porous textile surface layer applied to an upwardly facing surface of said intermediate layer, said surface layer providing a smooth upwardly facing putting surface upon which a golf ball can be putted; and a waffling layer applied to the downwardly facing surface of the base layer, said waffling layer having a plurality of generally horizontally extending channels which helps carry water away from under the base layer;

said surface layer and said intermediate layer being sufficiently porous to enable water disposed on said surface layer to seep through said surface layer and said intermediate layer;

said base layer including at least one drainage channel which extends in a generally vertical orientation through the base layer from the upwardly facing surface of said base layer to the downwardly facing surface of said base layer, said drainage channel draining away water which has seeped through said surface and intermediate layers.

2. The artificial golf putting surface of claim 1 wherein said intermediate layer comprises a porous rubber composite material.

3. The artificial golf putting surface of claim 2 wherein said porous rubber composite material comprises a composite of rubber granules and a urethane resin.

4. The artificial golf putting surface of claim 1 wherein said surface layer comprises a porous woven carpet material, said surface layer being adhered to said intermediate layer with a carpet adhesive.

5. The artificial golf putting surface of claim 2 wherein said surface layer comprises a porous woven carpet material, said surface layer being adhered to said intermediate layer with a carpet adhesive.

6. The artificial golf putting surface of claim 3 wherein said surface layer comprises a porous woven carpet material, said surface layer being adhered to said intermediate layer with a carpet adhesive.

7. An artificial golf putting surface comprising:

an expanded polystyrene foam base layer having a downwardly facing surface which is received on a supporting surface, and an upwardly facing surface having a predetermined surface contour;

a rigid intermediate sealing layer applied to said upwardly facing surface of said base layer;

a porous textile surface layer applied to an upwardly facing surface of said intermediate layer, said surface layer providing a smooth upwardly facing putting surface upon which a golf ball can be putted; and a waffling layer applied to the downwardly facing surface of the base layer, said waffling layer having a plurality of generally horizontally extending channels which helps carry water away from under the base layer;

at least one drainage channel which extends in a generally vertical orientation through the base layer and the intermediate layer from the upper surface of the intermediate layer to the downwardly facing surface of the base layer, said drainage channel draining away water which has seeped through said surface layer, said surface layer being sufficiently porous to enable water disposed on said surface layer to seep through said surface layer.

8. The artificial golf putting surface of claim 7 wherein said intermediate layer comprises a substantially rigid urethane polymer.

9. The artificial golf putting surface of claim 7 wherein said surface layer comprises a porous woven carpet material, said surface layer being adhered to said intermediate layer with a carpet adhesive.

10. The artificial golf putting surface of claim 8 wherein said surface layer comprises a porous woven carpet material, said surface layer being adhered to said intermediate layer with a carpet adhesive.

* * * * *